US006555965B1

(12) United States Patent
Oberle

(10) Patent No.: US 6,555,965 B1
(45) Date of Patent: Apr. 29, 2003

(54) INTEGRAL HOUSING FOR LOW PROFILE FLUORESCENT LAMP

(75) Inventor: Joseph C. Oberle, Chagrin Falls, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/692,363

(22) Filed: Oct. 19, 2000

(51) Int. Cl.[7] ..... H01J 13/46

(52) U.S. Cl. ..... 315/58; 315/61; 315/209 R; 362/260; 362/216; 362/221

(58) Field of Search ..... 315/58, 61, 73, 315/209 R, 182, DIG. 5; 362/260, 216, 221, 294; 313/318.02, 318.12, 493, 634

(56) References Cited

U.S. PATENT DOCUMENTS 4,109,303 A 8/1978 Hetherington ..... 362/216
4,173,730 A * 11/1979 Young et al. ..... 315/53
4,178,535 A * 12/1979 Miller ..... 315/53
4,316,120 A * 2/1982 Cotman et al. ..... 315/58
4,386,296 A 5/1983 Beck ..... 315/53
4,845,408 A * 7/1989 Pai ..... 315/238
5,128,590 A * 7/1992 Holzer ..... 315/58
5,471,375 A 11/1995 Lau ..... 362/260
5,491,385 A * 2/1996 Nilssen ..... 315/178
5,627,432 A * 5/1997 Balazs et al. ..... 313/635
5,629,581 A * 5/1997 Belle et al. ..... 313/318.12
6,459,215 B1 * 10/2002 Nerone et al. ..... 315/291

* cited by examiner

*Primary Examiner*—Haissa Philogene
(74) *Attorney, Agent, or Firm*—Fay, Sharpe, Fagan, Minnich & McKee, LLP

(57) ABSTRACT

A fluorescent lamp assembly that has a planar configuration with an open area defined within the lamp tube. A low profile, integral common housing encloses a ballast and a portion of the lamp structure within the open area of the lamp tube. The housing mechanically secures the lamp tube and contains an electrical connector allow the lamp electronics to plug into an electrical main. The electronics and the lamp are contained in a common structure so they can be used, handled, and discarded as a single unit.

19 Claims, 5 Drawing Sheets

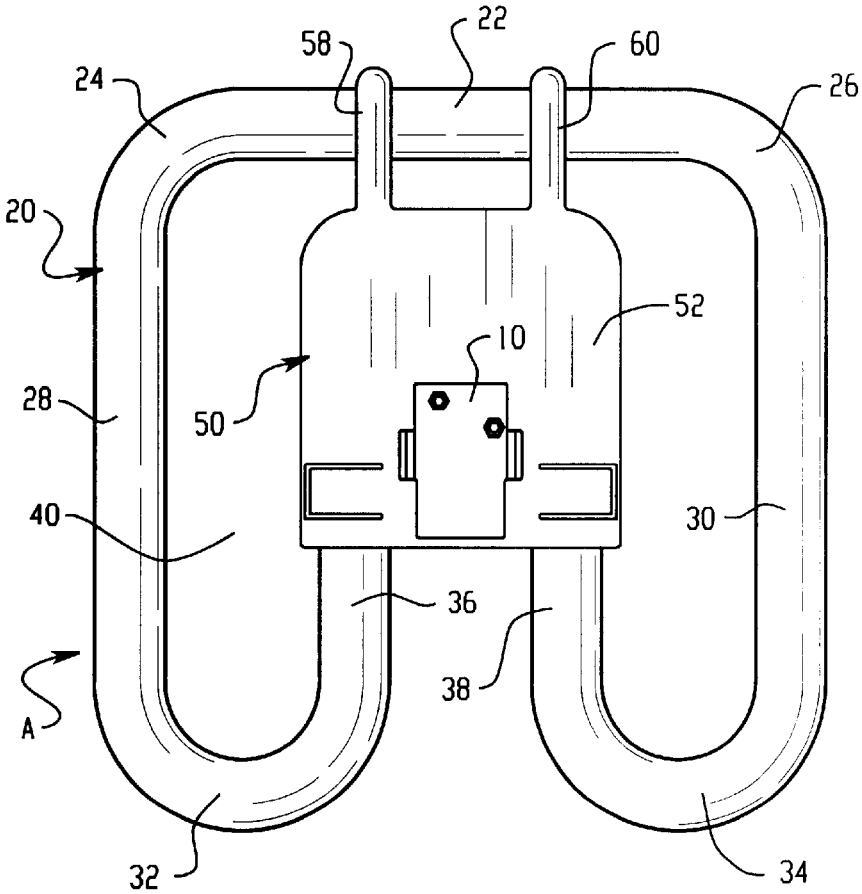
Fig. 1
Fig. 3
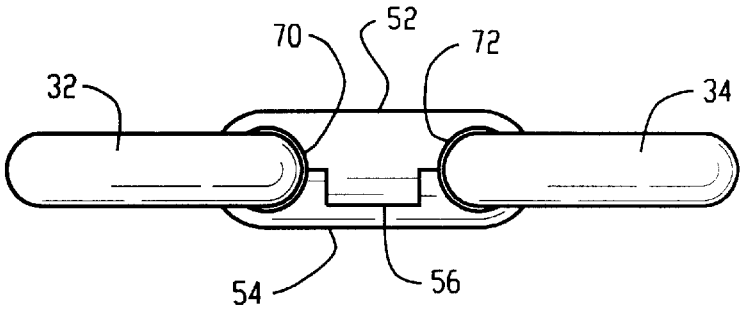
Fig. 2

INTEGRAL HOUSING FOR LOW PROFILE FLUORESCENT LAMP

BACKGROUND OF THE INVENTION

1. Field of the Invention

This invention relates to an electronically self-ballasted fluorescent lamp system. More particularly, the fluorescent lamp is substantially planar, i.e., flat, and encloses a low profile housing within an open area inside the fluorescent lamp in which an integral, common housing encloses the ballast and the lamp ends to securely hold the assembly together.

2. Discussion of the Art

Fluorescent lamps are generally economical to operate and thus the energy savings makes them a desirable lamp. One particular type of fluorescent lamp that has found commercial acceptance is referred to as a "2D" lamp in which the lamp is generally shaped like a pair of capital letter Ds disposed in back-to-back, or mirror, relationship. The lamp is an elongated tube bent into the desired 2D shape. Typically, a first housing receives first and second ends of the lamp tube, and a second housing carrying the electronic ballast components is adapted for selective connection to and extends outwardly from one face of the generally planar lamp assembly. Thus, although the tube of the lamp assembly is configured in a substantially planar configuration, and the first housing receiving the lamp ends has a generally planar, low profile, the second or ballast housing extending outwardly from the lamp assembly defeats the advantages offered by the low profile lamp arrangement.

Fixture manufacturers are always searching for an extremely flat or planar lamp product that provides good light output. The system must be low cost and have a high efficiency to optimize the benefits to the consumer. For example, it would be desirable to have a lamp assembly that plugs into an electrical main, while at the same time being held securely in place until such time that the consumer desires to remove the lamp from the fixture, for example, when it reaches the end of its useful life or burns out.

Typically, the ballast is designed to have a life expectancy significantly greater than the lamp tube. However, it then becomes necessary to design the lamp so that it is easily removed without special tools. The design must also assure that good mechanical and electrical connections are made in the original lamp assembly, as well as when a consumer replaces the lamp tube. Accordingly, it is deemed desirable to combine the electronics and the lamp into a common structure so that the entire lamp assembly can be used, handled, and even discarded as a single unit.

BRIEF SUMMARY OF THE INVENTION

A fluorescent lamp assembly includes an integral, common housing that mechanically receives opposite ends of the lamp tube and also encloses lamp electronics therein. The lamp tube has a curved configuration disposed in a single plane. The lamp housing has a low profile that provides good light output while being confined within an inner space of the lamp.

The lamp can be advantageously smaller and more economical since the ballast or electronics need not survive longer than the lamp.

Any wattage lamp can potentially work in an arbitrary fixture socket.

The high frequency electronics ballast allows the construction of a very light weight, economical, high efficiency lighting product with good light output.

The lamp assembly is optimally thin and exhibits a low profile essentially limited only by the lamp thickness because the electronics, lamp, and recess connector all share the same housing and are preferably confined within the planar profile of the lamp.

Moreover, the shape, size, and position of the ballast prevents interference with the lamp ends or tip-offs.

BRIEF DESCRIPTION OF THE DRAWINGS

FIG. 1 is a planar view of a fluorescent lamp assembly.

FIG. 2 is a top view of FIG. 1.

FIG. 3 is an end view taken generally from the right-hand end of FIG. 1.

DETAILED DESCRIPTION OF THE INVENTION

Figure 4:
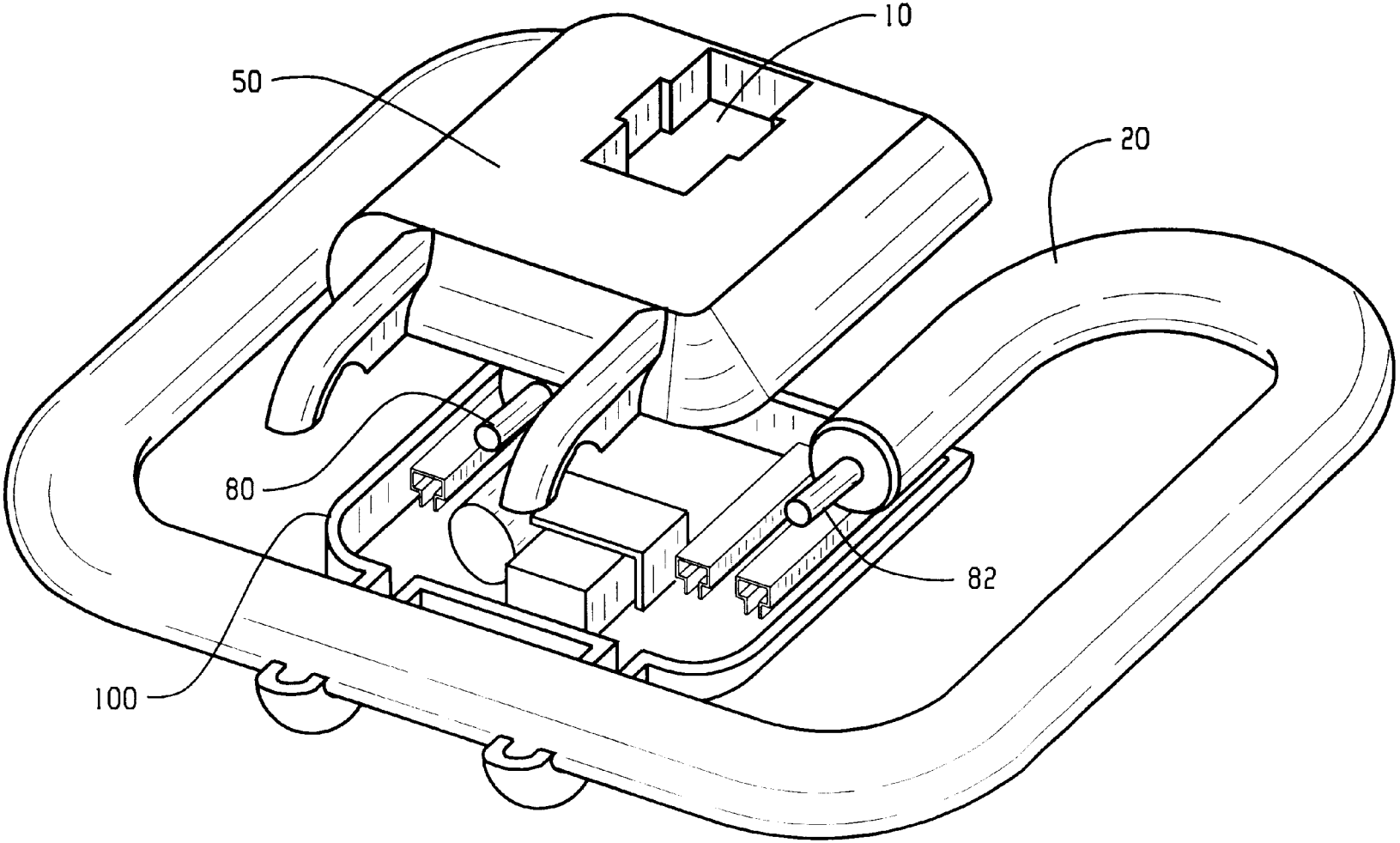
FIG. 4 is an exploded view of the lamp assembly in perspective.

FIG. 1 illustrates a fluorescent lamp assembly A that includes a fluorescent lamp envelope or glass tube 20 that is configured or bent to a substantially planar conformation. The lamp tube is bent into what is generally referred to as a 2D conformation. It includes a substantially linear portion 22 bent at opposite ends 24, 26, into second, generally parallel segments 28, 30 and further into bent regions 32, 34 which proceed toward the lamp ends 36, 38. The lamp tube substantially encloses an open central region 40. The lamp ends are preferably disposed in generally parallel relation as they enter a housing 50 received in the central region.

The housing is an integral, common structure that receives and mechanically retains the ends of the limp tube and also encloses the lamp electronics that are operatively connected to lamp leads. FIGS. 2–4 illustrate that the integral housing is originally formed of two mating portions 52, 54 that interlock along a tongue-and-groove portion 56 (FIG. 2). First and second arms 58, 60 extend from the first portion 52 of the housing and mate with first and second arms 62, 64 (FIGS. 5–8) extending from the housing second portion. Each of the arms includes a curvilinear recess or C-shaped recess 66 dimensioned for mating conformation with the outer periphery of the lamp tube. In particular, the arms are dimensioned for receipt over the first linear region 22 of the lamp tube to provide support at a central region of the extended length of the lamp tube. When the housing portions 52, 54 are brought into engagement, the recesses 66 in the arms define through openings that engage the outer periphery of the lamp tube. In addition, each housing portion includes semicircular recesses 70, 72 at a location generally opposite the arms. The recesses 70, 72 are adapted to closely receive the first and second ends 36, 38 of the tube. Thus, the elongated tube is mechanically supported by the housing at four distinct regions; namely, at the first end 36, by arm 58, by arm 60, and at the second end 38.

Figure 6:
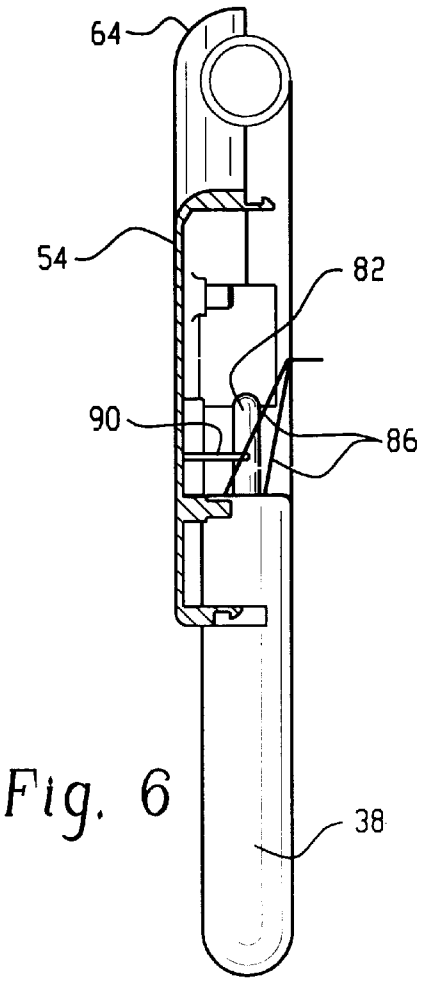
FIG. 6 is a cross-sectional view taken generally along the lines 6—6 of FIG. 5.
Figure 5:
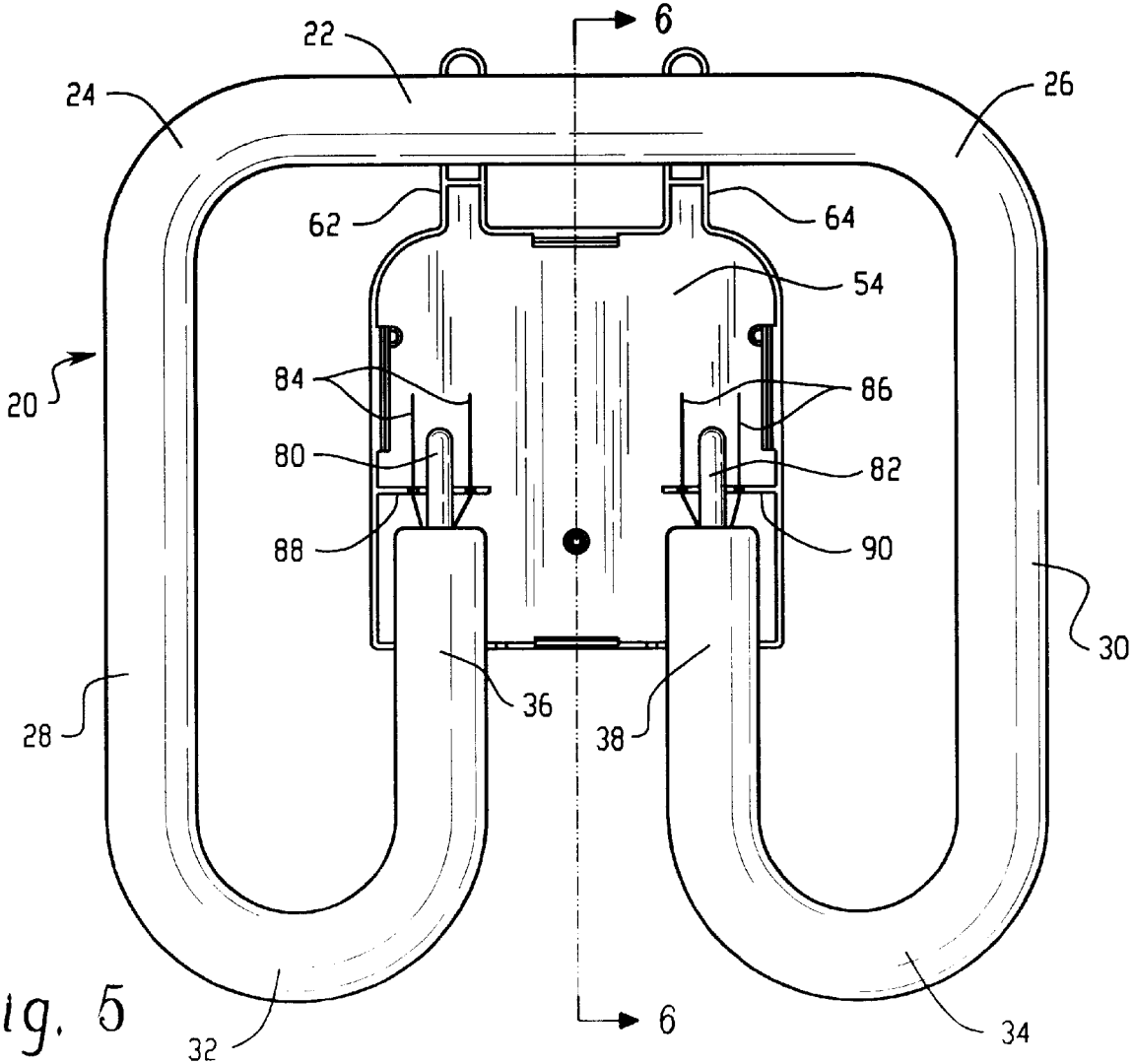
FIG. 5 is a plan view of the lamp assembly with a portion of the housing removed for ease of illustration.
Figure 8:
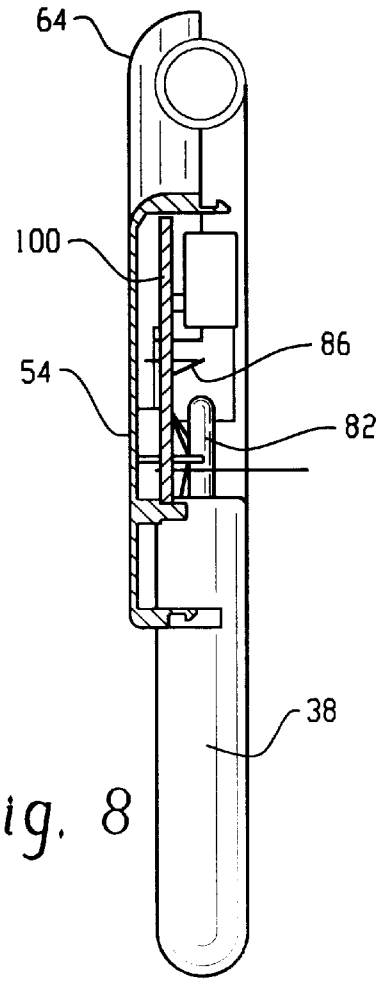
FIG. 8 is a sectional view taken generally along the lines 8—8 of FIG. 7
Figure 7:
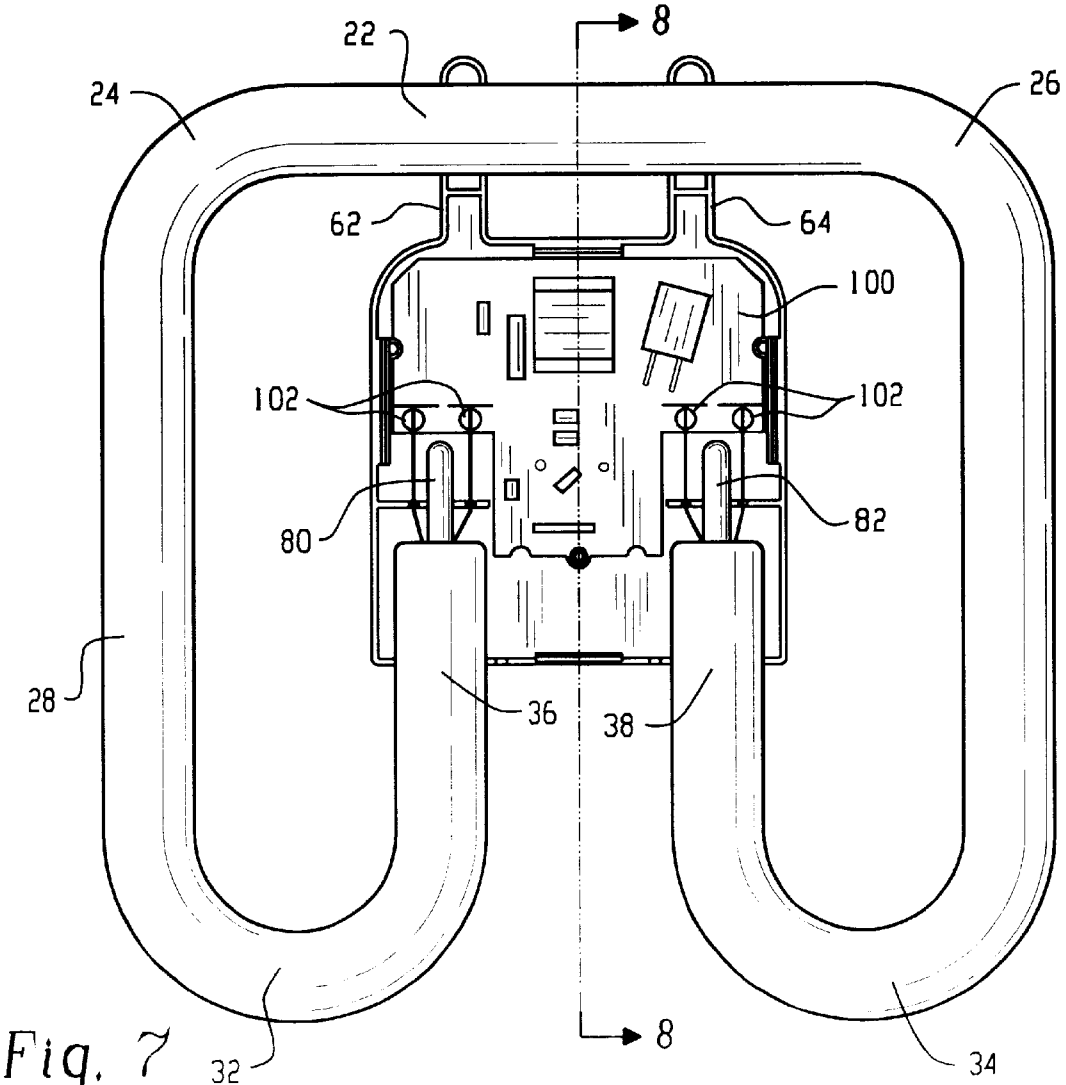
FIG. 7 is a plan view similar to FIG. 5, with the lamp electronics added thereto.

With particular reference to FIGS. 4–8, additional details of the mechanical and electrical connections will be described. Lamp tip-offs or exhaust tubes 80, 82 are formed in the end of the glass tube as is well know in the art. In addition, electrode leads 84, associated with the first end, and electrode leads 86, associated with the second end, extend outwardly from the glass tube for receipt in the housing. Support members 88, 90 receive and support the lamp tip-offs within the housing. The electrode leads 84, 86 are angled outwardly away from the second housing portion 54 as best illustrated in FIG. 6. Upon introduction of lamp electronics board 100 (FIGS. 7 and 8), the electrode lead ins are of sufficient length so that the leads are fed through openings 102 in the board and electrical connections completed. As perhaps best illustrated in FIGS. 7 and 8, the electrode leads pass over the supports 88, 90, respectively, on a first face of the board, and then are deflect to the other face of the board before protruding through the openings 102 toward the first face of the board again. Details of the lamp electronics incorporated into the electronics board 100 can be found in commonly-owned U.S. patent application Ser. No. 09/ 637,768, filed Aug. 11, 2000, now U.S. Pat. No. 6,459,215. By incorporating the electronics into the same housing as the lamp ends, and particularly using an electronics board as referenced in the co-pending application, a single, common housing having a low profile is achieved. The electronics is designed for substantially the same intended useful life as that of the fluorescent tube. Therefore, the electronics package can be smaller and more economical.

By incorporating the ballast, the lamp, and a recessed connector 10 to one housing, all confined within the planar space of the lamp, the overall lamp thickness is optimized to be as small as possible. As is particularly evident in FIGS. 1–3, the housing is substantially equi-spaced relative to the plane defined by the lamp tube. That is, the housing is centered in the same plane so that extensions of the housing from either side of the plane defined by the lamp tube are minimized. As will be noted, the overall thickness of the assembly is less than twice the diameter of the lamp tube. Just as importantly, minimizing the profile of the housing reduces any potential impact on the light output of the lamp assembly.

Figure 10:
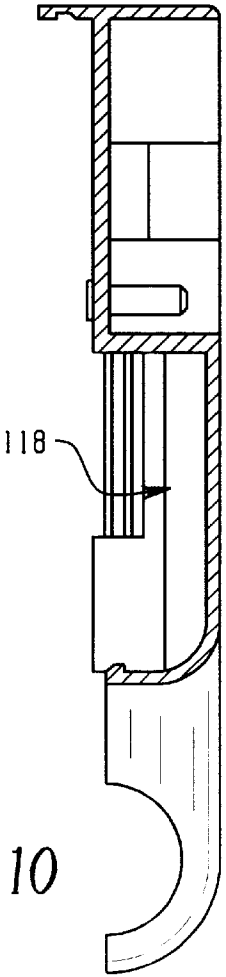
FIG. 10 is a sectional view taken generally along the lines 10—10 of FIG. 9.
Figure 9:
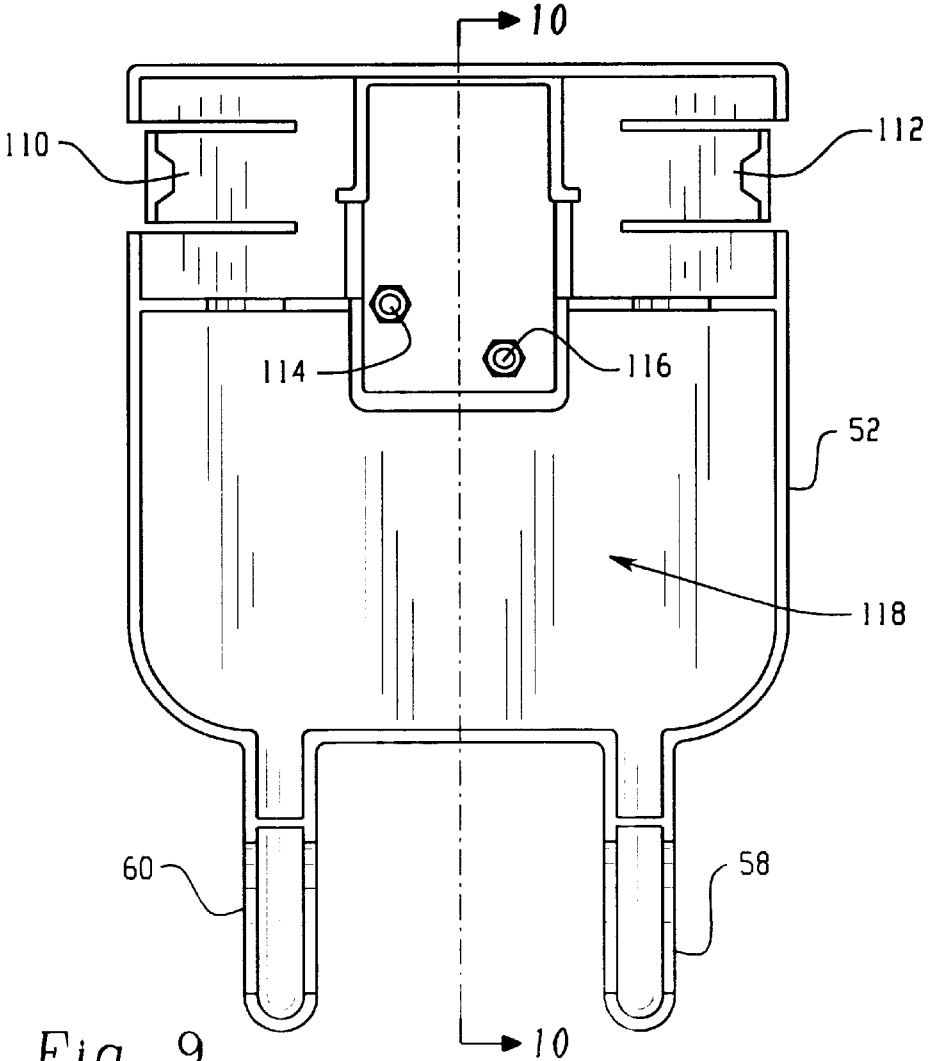
FIG. 9 is a plan view of one of the housing portions.

FIGS. 9 and 10 more particularly illustrate details of the first housing portion 52. As previously noted, a housing portion 52 includes arms 58, 60 having recesses 66 that are received about the linear portion 22 of the lamp tube. In addition, flexible retaining tab portions 110, 112 are formed in the housing and adapted for mechanically engaging the outer diameter of the ends 36, 38 of the fluorescent tube. In this manner, when the tube ends are received in the housing, the retaining tabs 110, 112 are flexed outwardly from an at rest position and thus exert a holding force on the tube ends to secure them in place once the housing is assembled. The housing portions 50, 54 may be snap fit, adhesively secured, or joined together with fasteners 114, 116. Enlarged cavity 118 is intended to accommodate the surface mount components of the lamp electronics mounted on board 100.

In summary, the fluorescent tube has an elongated length that fits into a compact structure due to its curvilinear configuration, i.e., the 2D configuration. A central, open area defined by the lamp tube is usefully exploited in the low profile unitary housing 50. The common housing does not extend appreciably outward from the plane of the lamp tube and advantageously mechanically secures the lamp ends, as well as providing mechanical support along the linear region 22 of the lamp tube. Moreover, the housing is dimensioned to receive the lamp electronics without adversely impacting on the operation of the lamp or overheating the electronics. The overall thickness of the lamp assembly is no greater than twice the thickness or diameter of the lamp tube. The housing is preferably centrally mounted relative to the plane of the lamp tube so that the overall profile of the lamp assembly is minimized. Particular details of the low pressure discharge tube, phosphor, gas fill, and details of the electrical circuit are generally known to those skilled in the art so that further discussion herein is deemed unnecessary to a full and complete understanding of the present invention. If necessary, the tube ends 36, 38 may be additionally adhesively secured in the housing. The fluorescent lamp and the lamp electronics have closely matched life expectancies. Moreover, by mating the lamp electronics with a specific individual lamp, the lamp electronics are more finely tuned to the operational range of the specific lamp with which it is integrated. This provides for improved operation for the lamp electronics and reliably controls operation of the lamp.

As is shown in the drawings, the electronics housing is supported by or hangs from the lamp tube. However, the relationship of the tube ends 36, 38 and the first and second arms supporting the electronics housing from the lamp tube may be altered from the particular arrangement shown and described herein without departing from the scope and intent of the invention.

While the invention has been described with respect to a specific embodiment, modifications and alterations will occur to others skilled in the art. For example, other configurations of a planar lamp, such as a circular lamp, can use various features of the invention. The appended claims are intended to cover all such modifications and alterations insofar as they fall within the scope of the present invention.

What is claimed is:

1. A fluorescent lamp assembly comprising:

a lamp envelope having a curved configuration disposed in a single plane and that receives a fill gas therein;

lamp electronics for controlling operation of the lamp; and an integral, common housing receiving opposite ends of the lamp envelope and the lamp electronics therein, wherein the common housing is centrally located in the single plane.

2. The lamp assembly of claim 1 wherein the housing, lamp envelope and lamp electronics are configured as a single unit.

3. The lamp assembly of claim 1 wherein the lamp envelope configuration has an open central region substantially surrounded by the lamp envelope.

4. The lamp assembly of claim 1 wherein the lamp envelope includes first and second ends each having an electrical lead extending outwardly from the envelope for receipt in an electrical connector associated with the lamp electronics.

5. The lamp assembly of claim 1 wherein the overall thickness of the lamp assembly is no greater than twice a diameter of the lamp envelope.

6. The lamp assembly of claim 1 wherein the lamp electronics are configured to have substantially the same intended useful life as that of the lamp envelope with the fill gas.

7. A fluorescent lamp assembly comprising:

a fluorescent lamp having a curved configuration disposed in a single plane substantially defining a planar space and delineating an open area lying within said planar space;

an integral, common housing into which ends of the fluorescent lamp enter and are fixedly mounted, the ends having electrode leads extending from the ends inside the common housing;

lamp electronics electrically connected to and lying adjacent to the fixedly mounted fluorescent lamp at the electrode leads of the mounted fluorescent lamp wherein the lamp electronics lie within the open area within the planar space;

wherein the lamp electronics are confined to within the common housing;

the tube ends being inserted and fixed into one side of the common housing;

the fluorescent lamp extending from the one side of the common housing and looping around same in spaced relation thereto to define a generally straight central segment spaced on the opposite side of the common housing from the lamp ends; and the common housing having a pair of lamp support arms extending from the common housing to the central segment and supportively engaging same.

8. The lamp assembly of claim 7 wherein the lamp electronics are configured to have substantially the same useful life as that of the lamp envelope with a fill gas.

9. The lamp assembly of claim 7 wherein operation characteristics of the lamp electronics are mated to the lamp envelope of the assembly.

10. The lamp assembly of claim 7 wherein the common housing further includes a recessed connector.

11. A fluorescent lamp assembly comprising:

a fluorescent lamp envelope configuration disposed in a substantially planar conformation, the lamp envelope bent into a 2D conformation, and including lamp ends which are disposed in a generally parallel relation to each other and, electrode leads extending outwardly from the lamp envelope;

an electronic board for controlling operation of the lamp, and designed to receive the electrode leads; and a housing sized to receive at least the lamp ends and electrode leads, and the lamp electronics wherein connection between the electrode leads and lamp electronics are made within the housing.

12. The lamp assembly of claim 11 wherein the housing, lamp envelope and lamp electronics are configured as a single unit.

13. The lamp assembly of claim 11 wherein the lamp envelope configuration has an open central region substantially surrounded by the lamp envelope.

14. The lamp assembly of claim 11 wherein the housing is centrally located in a single plane.

15. The lamp assembly of claim 11 wherein the lamp electronics are located within an open central region substantially surrounded by the lamp envelope.

16. The lamp assembly of claim 11 wherein the housing mechanically secures the lamp ends therein.

17. The lamp assembly of claim 11 wherein the overall thickness of the lamp assembly is no greater than twice a diameter of the lamp envelope.

18. The lamp assembly of claim 11 wherein operation characteristics of the lamp electronics are mated to the lamp envelope of the assembly.

19. The lamp assembly of claim 11 wherein the common housing further includes a recessed connector.

* * * * *